US006419480B2

(12) United States Patent
Al-Halbouni

(10) Patent No.: US 6,419,480 B2
(45) **Date of Patent: *Jul. 16, 2002**

(54) METHOD AND APPARATUS FOR PROVIDING LOW LEVEL $NO_X$ AND CO COMBUSTION

(76) Inventor: Ahmad Al-Halbouni, Heimsplatz 5, 39110 Magdeburg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/981,247

(22) PCT Filed: Apr. 18, 1997

(86) PCT No.: PCT/DE97/00817

§ 371 (c)(1),
(2), (4) Date: Dec. 17, 1997

(87) PCT Pub. No.: WO97/40315

PCT Pub. Date: Oct. 30, 1997

(30) Foreign Application Priority Data

Apr. 20, 1996 (DE) ..... 196 15 761

(51) Int. Cl.[7] ..... F23D 14/20; F23C 5/08

(52) U.S. Cl. ..... 431/351; 431/177; 431/179; 431/186; 431/10; 431/12; 431/165; 431/11; 431/185

(58) Field of Search ..... 431/8, 10, 12, 431/328, 329, 351, 326, 355, 335, 9, 11, 285, 278, 164, 165, 352, 353, 354, 185, 186, 177; 362/171, 159, 179, 180; 239/553.3, 559; 60/732

(56) References Cited

U.S. PATENT DOCUMENTS

| | | | | | |
|---|---|---|---|---|---|
| 14,414 | A | * | 3/1856 | Shaw | 239/553.3 |
| 461,219 | A | * | 10/1891 | Jeavons et al. | 431/335 |
| 1,452,563 | A | * | 4/1923 | Lewis | 431/335 |
| 1,527,758 | A | * | 2/1925 | Swartzentruber | 431/335 |
| 1,542,528 | A | * | 6/1925 | Rudkin | 431/335 |
| 1,670,033 | A | * | 5/1928 | Gilmore et al. | 431/335 |
| 2,065,265 | A | * | 12/1936 | Bock | 431/335 |
| 2,075,242 | A | * | 3/1937 | Todaro | 431/335 |
| 2,184,967 | A | * | 12/1939 | Winter | 431/335 |
| 2,256,183 | A | * | 9/1941 | Wojcicki | 431/335 |
| 2,375,598 | A | * | 5/1945 | Trosky | 431/335 |
| 2,390,059 | A | * | 12/1945 | Lancey | 431/335 |
| 2,423,079 | A | * | 7/1947 | Behrendt et al. | 431/335 |
| 2,663,366 | A | * | 12/1953 | Harris | 431/335 |
| 3,093,185 | A | * | 6/1963 | Lowry | 431/335 |
| 3,460,895 | A | * | 8/1969 | Yamaguchi | 431/335 |
| 3,938,934 | A | * | 2/1976 | Frondorf | 431/11 |

* cited by examiner

*Primary Examiner*—Henry Bennett
*Assistant Examiner*—Josiah C. Cocks
(74) *Attorney, Agent, or Firm*—Karl Hormann

(57) ABSTRACT

A low $NO_x$ and CO emission heating apparatus provides for substantially separate fuel and combustion air feeds into a combustion chamber provided at one end with an exhaust gas opening and, at an opposite end with an elongated porous air distributor through which air is fed into the combustion chamber and into jets of fuel directed into the space between the air distributor and the side wall of the combustion chamber. Both air and fuel may be subjected to swirl to improve the combustion, by adjusting the inclination of the fuel nozzles.

20 Claims, 12 Drawing Sheets

Figure 1A:
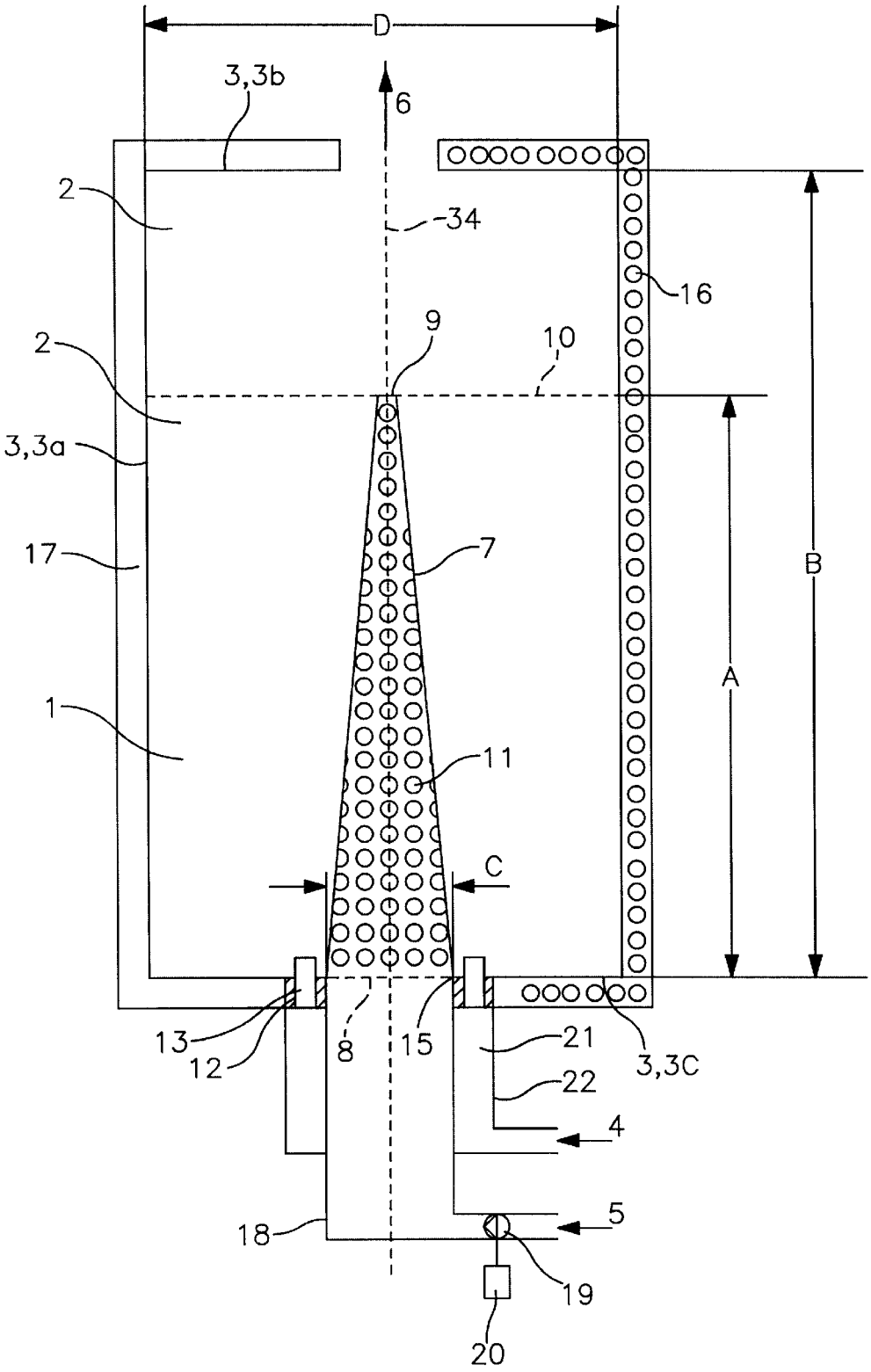

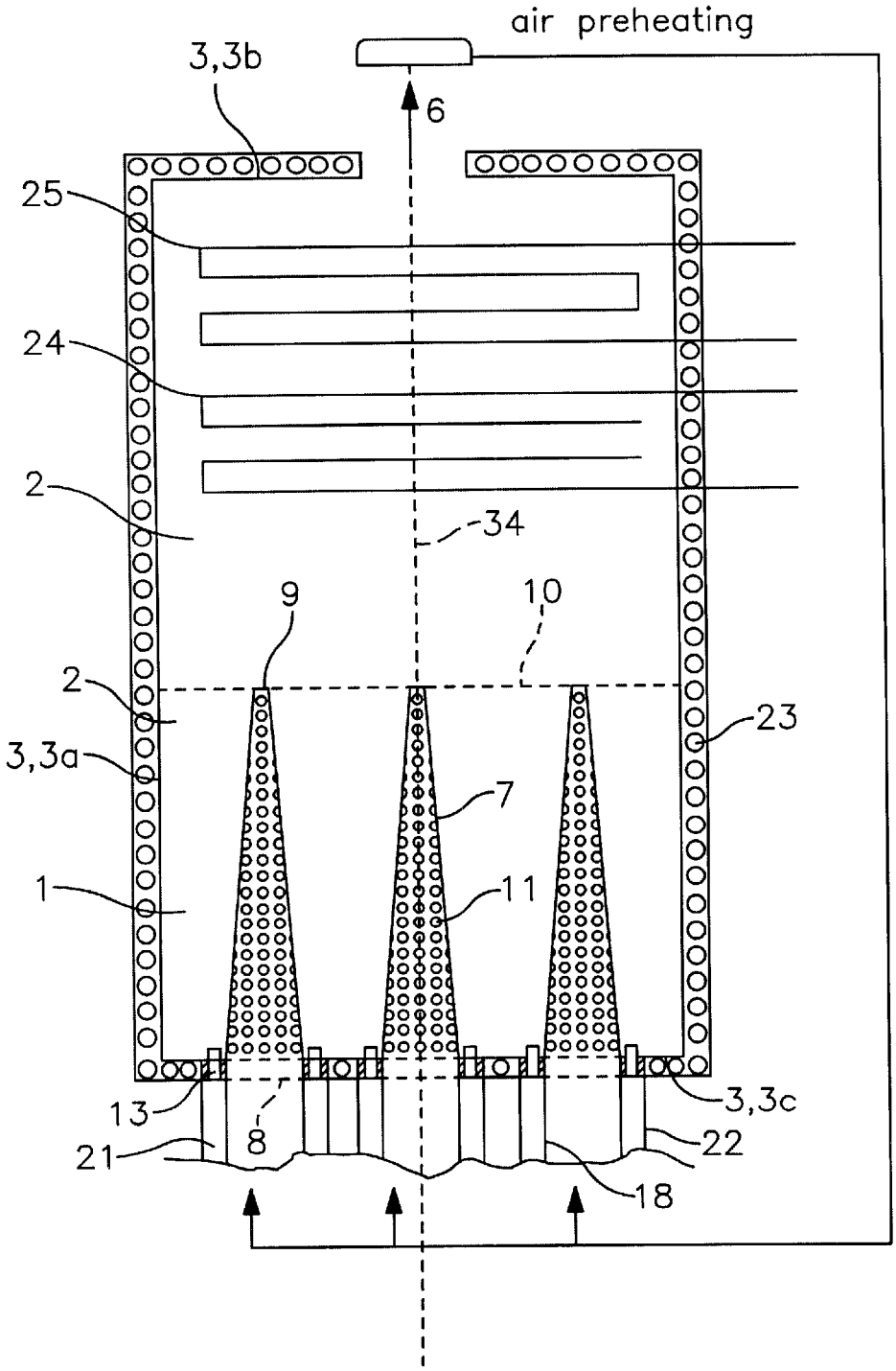
FIG. Ib

METHOD AND APPARATUS FOR PROVIDING LOW LEVEL $NO_X$ AND CO COMBUSTION

CROSS-REFERENCE TO RELATED APPLICATIONS

BACKGROUND OF THE INVENTION

1. Field of the Invention

The invention relates to a combustion device as well as to a method of providing low $NO_x$ and low CO combustion with substantially separate inputs for fuel and combustion air into a combustion chamber, wherein the entire or most of the combustion air is fed to the combustion chamber in continuous steps at several points in the chamber.

As used herein, the term fuel is intended to connote substances which react exothermally with oxygen and which are in a gaseous or vaporous state at ambient temperature and/or when fed into the combustion chamber. The term fuel further includes liquid or pulverized substances suspended in air, vapor and/or waste gas as a carrier gas. In this context, the term combustion air includes gas and/or vapors having an oxygen content sufficient to ensure a stable combustion of the selected fuel. The combustion air may contain waste gases. The term combustion zone as used herein is intended to include the spatial area in which the combustion takes place.

2. The Prior Art

In burners of the kind known from German published patent specifications DE-OS 4,419,345 and DE-OS 4,231,788 with separate feeding of fuel and combustion air into a combustion chamber, the combustion air is usually fed coaxially of the fuel injection. For this purpose, a fuel jet is generated near the mouth of the combustion device. The combustion air is fed peripherally of the fuel jet and outside of the flame region, through a substantially annular distributor, wherein the distributor is placed in the proximity of the fuel nozzle and substantially coaxially with respect to the fuel nozzle. Because of the significant space between the combustion air distributor and the flame region and, more particularly, the core of the flame, a uniform mixture of fuel and combustion air or a mixture composed of predetermined shares cannot be achieved in practice when operating this type of combustion device. In an attempt to reduce this disadvantage, the combustion air is segregated into primary air and secondary air, whereby locally limited peak values of oxygen concentration are lowered and the automatic control of stoichiometric ratios during combustion may thus be improved to some extent. The principal or main disadvantage of this type of combustion device, namely the unsatisfactory automatic control of the stoichiometric ratios of fuel and combustion air, is that the resultant formation of harmful and noxious substances of contaminants and pollutants, such as nitric oxides and carbon monoxide, can only be reduced at relatively high expense. A cause of this disadvantage is that the input of combustion air extends only over a relatively small spatial area of the combustion zone. Therefore, the stoichiometric ratios during combustion are essentially determined solely by the difficulty of controlling convection in the combustion zone. An attempt to reduce this disadvantage by special installations which provide for more intensive turbulence of fuel and combustion air does, however, entail a larger consumption of energy due to increased pressure losses.

Another method of reducing the formation of $NO_x$ in the combustion chamber of combustion devices not providing for partial premixing comprises injecting the combustion air and fuel at a high velocity into a combustion zone preheated to about 950° C. This is, however, an energetically and structurally complex solution, and pyrotechnically it is of little interest since it leads to long flames and does not result in an optimum mixture.

Frequently, a multi-stage input of combustion air is carried out to improve combustion and to lower the emission of harmful substances, such as pollutants and contaminants, in combustion devices not calling for premixing. Such a proposal is, for example, the subject of the combustion device according to German laid-open patent specification DE OS 4,041,360. This combustion device with a horizontal burner pipe provided at its upper surface with a plurality of gas exit openings comprises, within so-called jet-flow rods, additional openings above the primary air input for feeding of secondary air. The flow rods are intended to cool the flames. The thermal load and stress on such jet-flow rods is, however, very high so that only high-temperature resistant materials can be employed for these jet-flow rods. Moreover, an optimum automatic control of the combustion device as to harmful substances is rendered substantially more difficult at different thermal load levels because the ratio of primary air to secondary air quantities can be changed only within narrow limits. In particular, the input of secondary air into the upper flame zone is insufficient in the region of the full thermal load.

Attempts have been made to reduce these drawbacks by separate automatic controls of the secondary air input or by partial premixing, which may require expanding the two-step air input to a three-step or four-step air input. A combustion device of the kind operating in this manner has been described in German laid-open patent specification DE OS 4,142,401. The combustion device utilizes premixing and is operated substantially below stoichiometric levels of oxygen. The oxygen which is lacking for combustion is supplied only at a noticeable distance from the combustion mouth at one or several sites, whereby the direction in which the oxygen is injected must not be the same as, and parallel to, the main flow direction of the combustion gases. This method undoubtedly improves the operation of large size industrial furnaces, such as cylindrical rotary kilns, drum-type furnaces and the like, even though it is relatively difficult to control because of the complicated flow guidance of the combustion air which must be tuned to, or adjusted in accordance with, the geometry of the furnace walls. This method is, however, too expensive for the operation of compact combustion devices with lower thermal output rates. Moreover, this method suffers from the general disadvantage that in essence the combustion air is supplied to the area of the combustion zone in which the flame temperature is relatively high.

The advantages of a multi-step air supply are also applied in a special variant of burners without premixing and provided with a combustion chamber which expands conically in the direction of the flame, wherein the combustion chamber forms a diffuser and provides more intensive mixing of fuel and combustion air. Fuel and primary combustion air are fed into the combustion devices or burners of this type (see German laid-open patent specification DE OS 3,600,784) by the diffuser and are burned in said combustion devices. Secondary combustion air is additionally fed through wall openings in the diffuser in a direction radially of the flame. However, the length of the diffuser cannot be arbitrarily extended because the diffuser would then excessively shield the flame which would impair the transfer of heat to the furnace wall. Since the length of the flames can substantially surpass the length of the diffuser in case of higher thermal output rates, this means that insufficient secondary combustion air is fed to the region of the tip of the flames particularly at higher heat output rates. The effect as regards the emission of pollutants from the combustion device or burner is unfavorable.

In combustion processes of this method, the hottest flame zones are always in the interior of the diffuser and cause the walls of the diffuser to glow red hot. This is disadvantageous for two reasons: First, the glowing leads to an increased formation of environmentally hazardous nitric oxide due to the increased temperature and, second, special temperature resistant materials are required for the walls of the diffuser. Overall, the input of combustion air is restricted to relatively small spatial areas of the combustion zone in this kind of combustion device and, moreover, the relatively small spatial areas exhibit very high flame temperatures.

Another kind of air distribution as disclosed by U.S. Pat. No. 1,247,740 is utilized to improve the mixing of combustion air and fuel. The combustion air is fed into a mixing chamber through a plurality of openings in an elongate rounded wall disposed within a furnace chamber. This mixing chamber is encased by a second elongate rounded wall surrounding the first wall, and is closed at its head section by a sealed connection of the two walls. The resultant hollow, double-walled, cylindrical chamber remains open at its bottom section and is connected at its bottom section to an annular opening for the supply of fuel. The second (outer) wall of this double-walled annular cylinder is also provided with openings at which the air-gas mixture is ignited. The combustion occurs directly at these openings as well as at the surface of the outer wall, and many individual flames are formed. A substantial disadvantage of such combustion resides in the required special and expensive materials which must be capable of withstanding the high temperatures and thermal stresses; nevertheless they may have a limited useful life.

Even though the spatially multi-stage air supply provides for a sub-stoichiometric mixing zone in the bottom section which at an increasing air ratio gradually converts to a super-stoichiometric level, control of the mixing ratios cannot be ensured as complete mixing of fuel and combustion air is quickly achieved in the double-walled enclosed restricted chamber of the annular cylinder before ignition occurs at the openings of the outer wall. The combustion also suffers from the disadvantage of flames being formed before the mixing process has been completed. The reduction effect which is important for lowering the nitric oxide emission thus does not occur.

In addition, the exhaust gas discharge from the burner chamber cannot be utilized in combustion technologies relating to heating furnaces and industrial furnaces since it cannot insure an effective transmission of heat to the material to be heated.

Further disadvantages of this double-walled burner structure result, in addition to its disposition within the burner chamber, from its complicated structure.

Another way of improving the state of the mixture comprises an additional mixing chamber serially connected ahead of the combustion chamber which results in a combustion device or burner of enlarged dimensions. As a premixer combustion device or burner it suffers from all the disadvantages inherent in such devices. Such a combustion device with very intensive premixing is described, for example, in German laid-open patent specification DE-OS 3,915,704, which combustion device is of an extremely complex structure. Its multimember mixing channels require large quantities of energy in order to compensate for the pressure loss inherent in them. Furthermore, the mixing channels are difficult to access and are, therefore, difficult to clean.

The state of the art may be summarized as follows: There is a tendency in the construction of combustion devices to utilize a multistage supply of combustion air into the combustion chamber in order better to control the stoichiometric ratios during combustion and thereby to meet the current stringent governmental standards as to economical and ecological combustion. Continued adherence to such arrangements would, however, lead to relatively complicated burner structures with a plurality of combustion air distribution lines penetrating the furnace walls or any boiler shell disposed in the combustion zone, as well as additional jet-flow rods for cooling the flames. Such solutions are neither safe to operate nor suited for a compact construction.

Another developmental tendency makes use of the principle of surface combustion in order to achieve a good mixture, complete combustion, and low emission of hazardous substances. Accordingly, the air-gas mixture is distributed over the entire surface of the burner body, protruding into the burner chamber, through a plurality of openings, and is ignited therein. Combustion occurs directly at the surface and leads to red hot glowing of the surface. The combustion air is either mixed completely with the fuel before entering into the burner body, or it is input by means of a plurality of openings in the inner wall of a double-walled cylindrical combustion device structure into the cylindrical annular space enclosed between the inner wall and the outer wall, where the combustion air is mixed with the fuel. Subsequently, the mixture is ignited at the surface of the outer burner wall. All surface burners operating according to this principle require the use of expensive materials and suffer from particular complications during assembly of the burner in the furnace chamber. In addition, their useful life and their range of application are limited to low-efficiency ranges and to gaseous fuels.

A further development line in the construction of combustion devices or burners makes use of the vacuum pressure generated by the flow velocity of the flame gas in order to draw in secondary, tertiary, etc. combustion air. However, this principle requires the flame gases to flow at a predetermined velocity by a diffuser wall provided with suction openings for the combustion air. Therefore, the volume of combustion air drawn per unit of time cannot be changed independently of the flame parameters. Even though a compact structure facilitates limiting the space available for the formation of flames by the diffuser wall, such construction suffers from the following substantial disadvantage:

The suction openings for the combustion air are disposed in a zone of very high flame temperature which leads to increased formation of environmentally hazardous nitric oxides.

OBJECT OF THE INVENTION

The object of the invention is, therefore, to provide for a structurally simple combustion device suitable for a compact structure with substantially separate inputs of fuel and combustion air into the combustion chamber and which results in a combination of low $NO_x$ and CO emission as well as in intensified heat transfer between the flame/exhaust gas and the wall of the heat sink, wherein the combustion air is input into larger flame regions in as many stages as possible.

The object leads to the following subordinate tasks:

The quantity of combustion air fed per unit of time is metered in such a way that lambda number ranges of the mixture of fuel and combustion air preset in the combustion chamber are realized.

Decrease of thermal loads on the components groups to the combustion air feed and flame cooling as well as providing for the use of economical materials for the component groups.

Elimination of impairments of heat transfer between flame and wall of the heat sink otherwise resulting from diffusers and other means for mixing the fuel-combustion air streams.

Structuring the geometry of the combustion zone and exhaust gas zone so as to complement the walls of the heat sink.

SUMMARY OF THE INVENTION

According to the present invention, the object is accomplished by a combustion device having the features herein set forth in greater detail, as well as by a method of operating the combustion device in the most efficient way possible.

The basic concept of the invention, which also concerns the method of operating the combustion device, comprises the following: About 70 to 100 vol-% of the total quantity of combustion air supplied is furnished by one or more combustion air distributor units or diffusers in a substantially radial direction into a chamber permeated by the flame and disposed between the outer wall of the fire box and the contour of the combustion air distributor unit. The number of openings per surface unit and their cross-section distributed over the contour of the combustion-air distributor units are selected such that combustion air enters into the combustion zone at a preset flow rate. This facilitates control of the stoichiometric ratios of the mixture of fuel and combustion air. Furthermore, a predetermined curve of the range of lambda-numbers may be realized at the metering site between the base and the tip of the flame.

In contrast to the combustion air, fuel is fed into the combustion zone only in the vicinity of the base of the flame disposed at the portion of the combustion-air distributor unit by means of one or more rows of nozzles disposed around the combustion air distributor units.

If the throughput of air is less than 100%, the remaining air required for the combustion, i.e., 0 to about 30 vol-%, is mingled with the fuel before entering the combustion zone. The admixture of this portion of the combustion air increases the impulse of the fuel, improves the mixing of the fuel and the combustion air, and leads to a faster attainment of the ignition limit. This results in a drastic reduction of the $NO_x$ values.

The advantages of this concept are that combustion is initially at sub-stoichiometric oxygen values and that it achieves stoichiometric or super-stoichiometric oxygen values at gradually increasing air flow only a short distance before the tip of the flame where it brings about complete combustion. Temperature peaks or spikes are suppressed over the entire range of the flame, and the formation of harmful substances ($NO_x$ and CO) is drastically reduced. Feeding the combustion air in this manner yields the advantageous effect of the flame being blown away from the combustion-air distributor unit so that no direct combustion occurs at the surface thereof. This lowers the thermal load of the combustion air distributor units, especially since the combustion air flowing through provides additional cooling thereof.

A further advantageous result of combustion air feeding according to the invention, particularly in the case of large surface combustion air distributor units, is that they lead to simultaneous cooling of the flame whereby the formation of $NO_x$ is reduced. In addition, the use of large surface combustion air distributor units of suitable structural shape facilitates determination of the geometry of the combustion zone. For that reason, an essential function of the combustion air distributor unit is seen in the fact that the size of the combustion chamber is influenced in a significant way by a proper selection of the dimensions of the combustion air distributor units. In summary, a low thermal load of the combustion air distributor units is also achieved at varying outputs of the combustion device or burner since because of increasing combustion air throughput the cooling effect increases with increasing output of the combustion device.

The contour of the combustion air distributor units may be embodied in many different structures. Depending on the geometry of the furnace or the boiler space, an appropriate configuration of the combustion air distributor units may lead to an optimization in respect of $NO_x$ and CO emissions and in respect of heat transfer.

Additional advantageous embodiments of the invention relate to the structure of the linear arrays of nozzles for the fuel supply. For optimally maintaining preset ranges of values regarding the air lambda-number, it has been found to be particularly effective to direct the fuel jets of a given array and/or neighboring arrays to different longitudinal zones of the combustion air distributor units. At least some of the mentioned nozzles are preferably set at an angle relative to each other to impart a helical drift or swirl to the fuel. Furthermore, the combustion air distributor units and/or the fuel nozzles preferably are exchangeable for optimally adjusting their parameters to predetermined burner outputs.

DESCRIPTION OF THE SEVERAL DRAWINGS

Figure 2A:
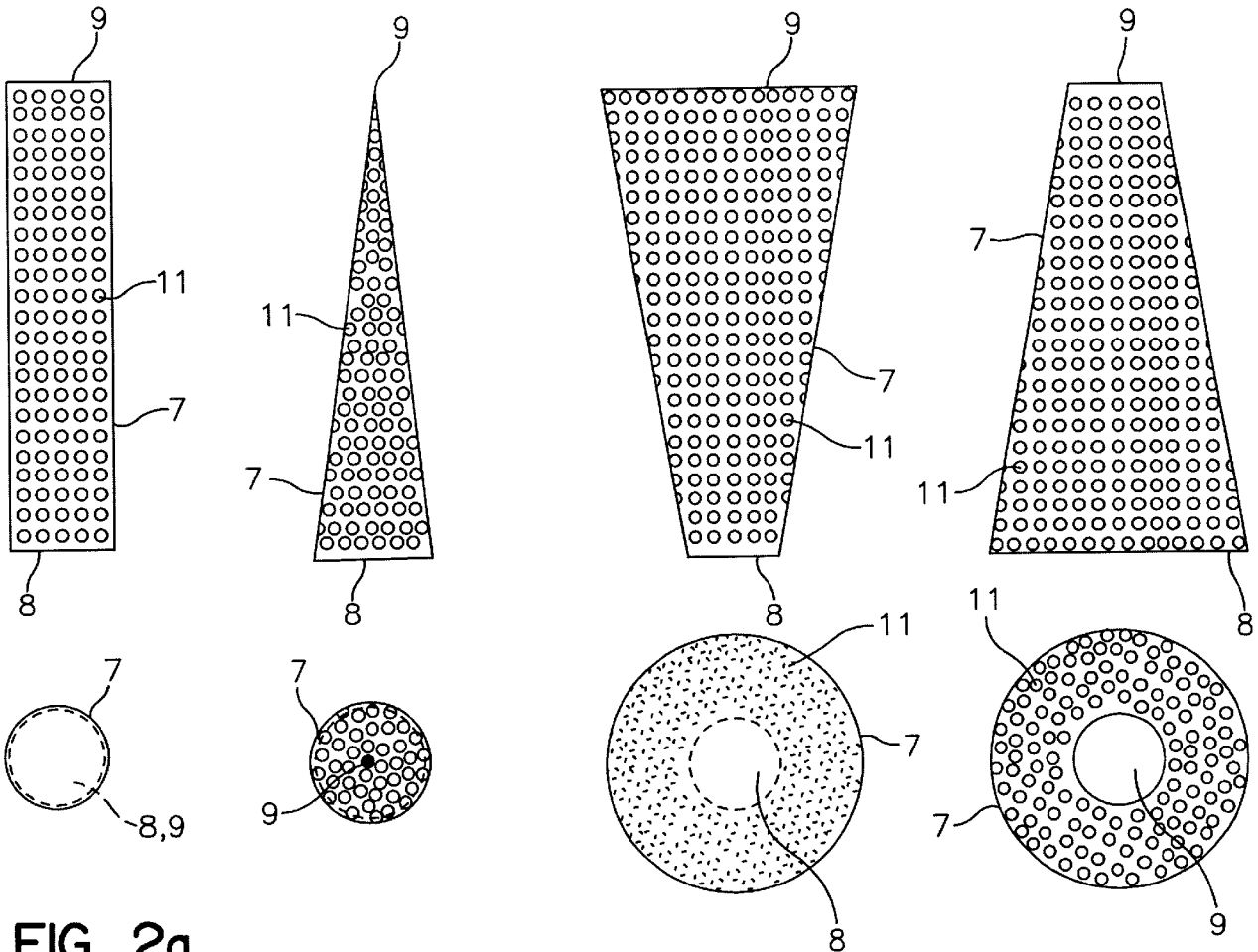
Figure 2B:
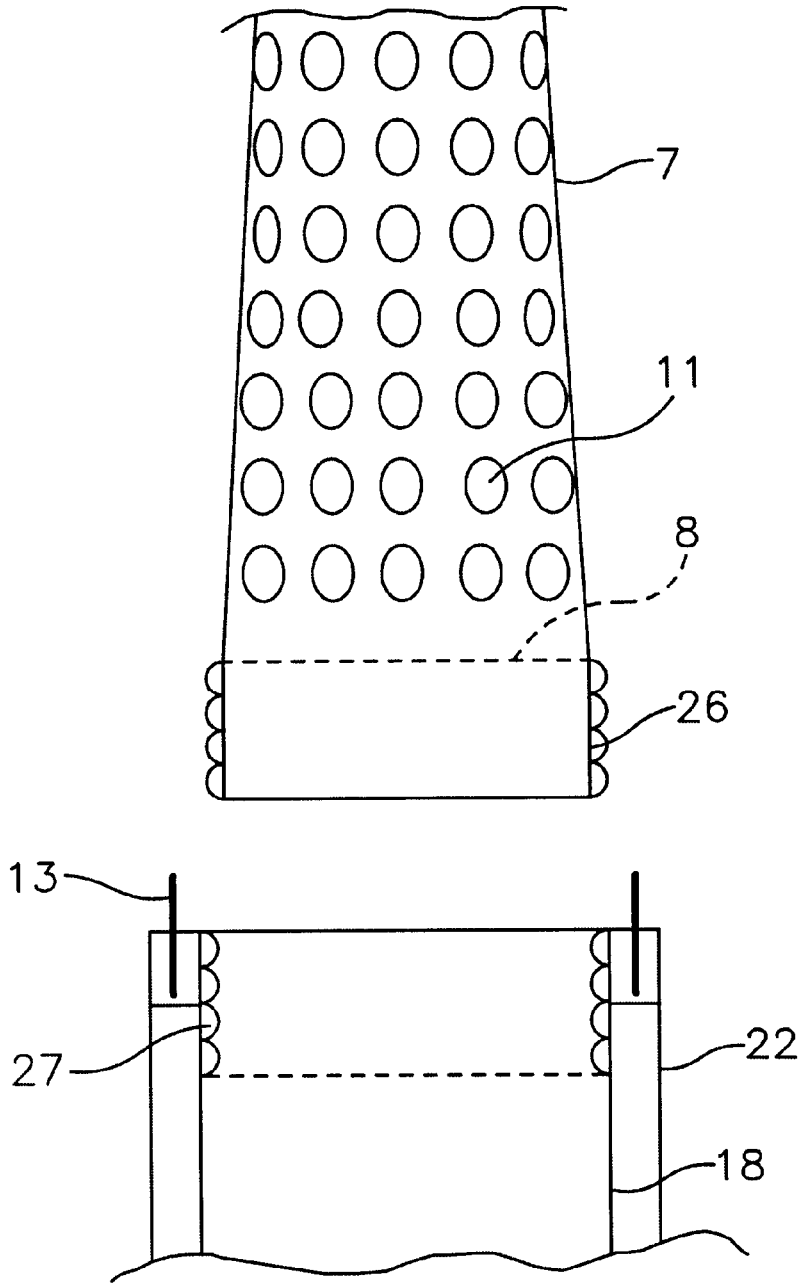
Figure 3A:
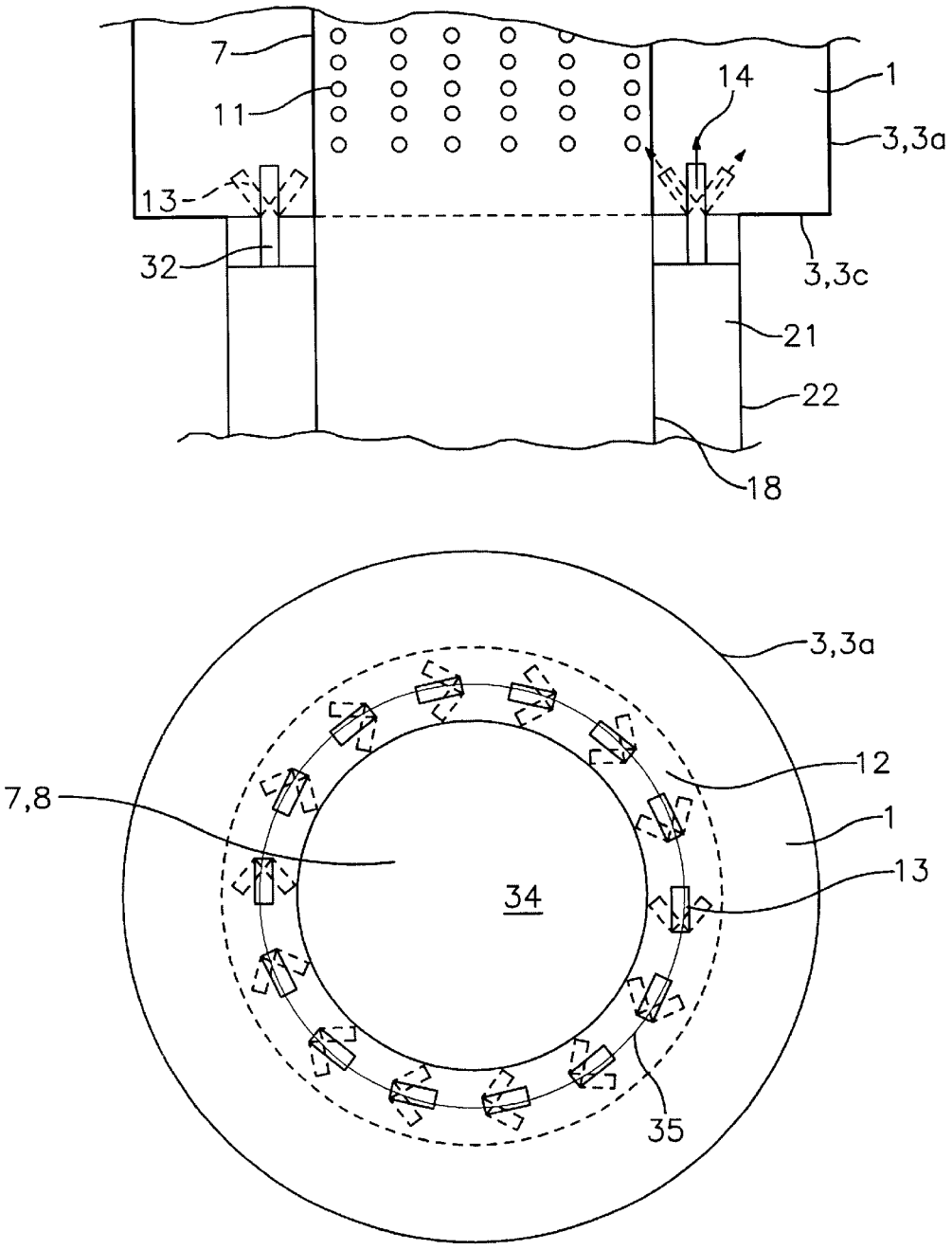
Figure 3B:
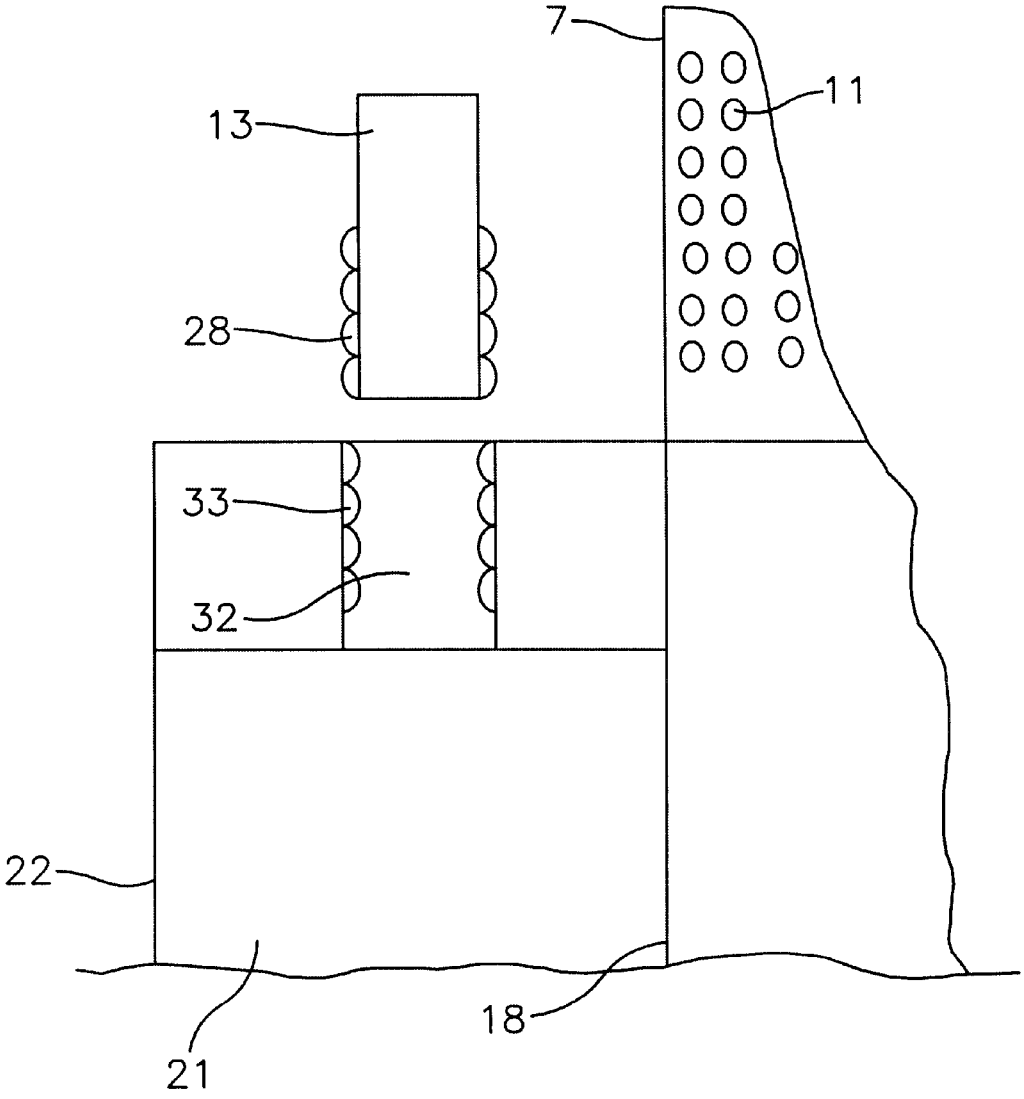
Figure 3C:
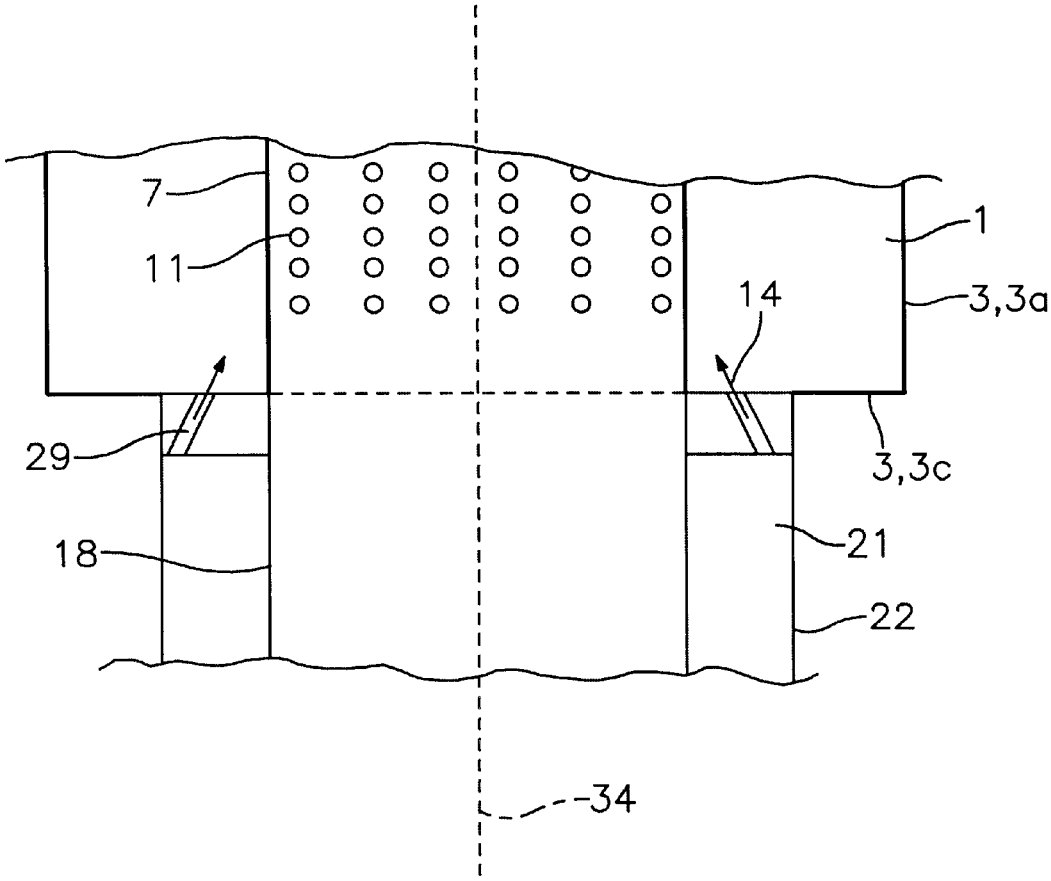
Figure 3D:
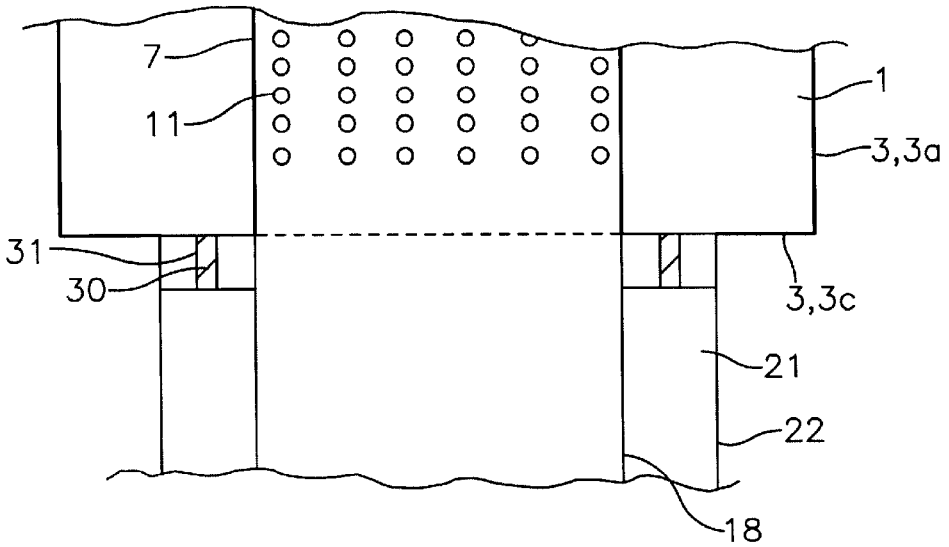
Figure 3D:
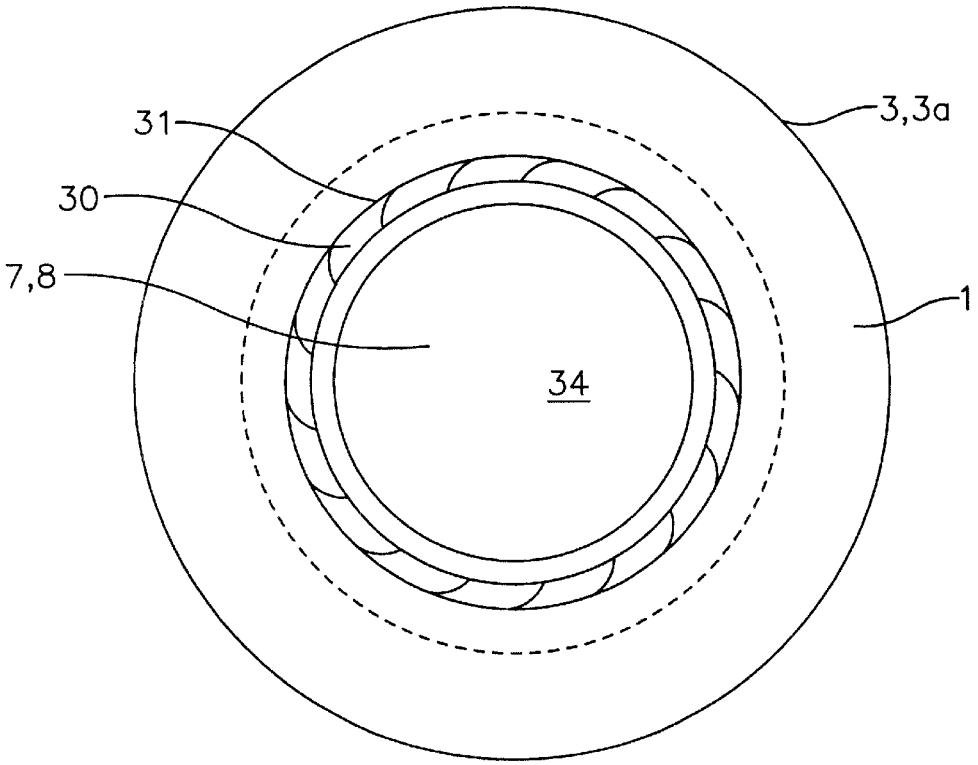
Figure 4A:
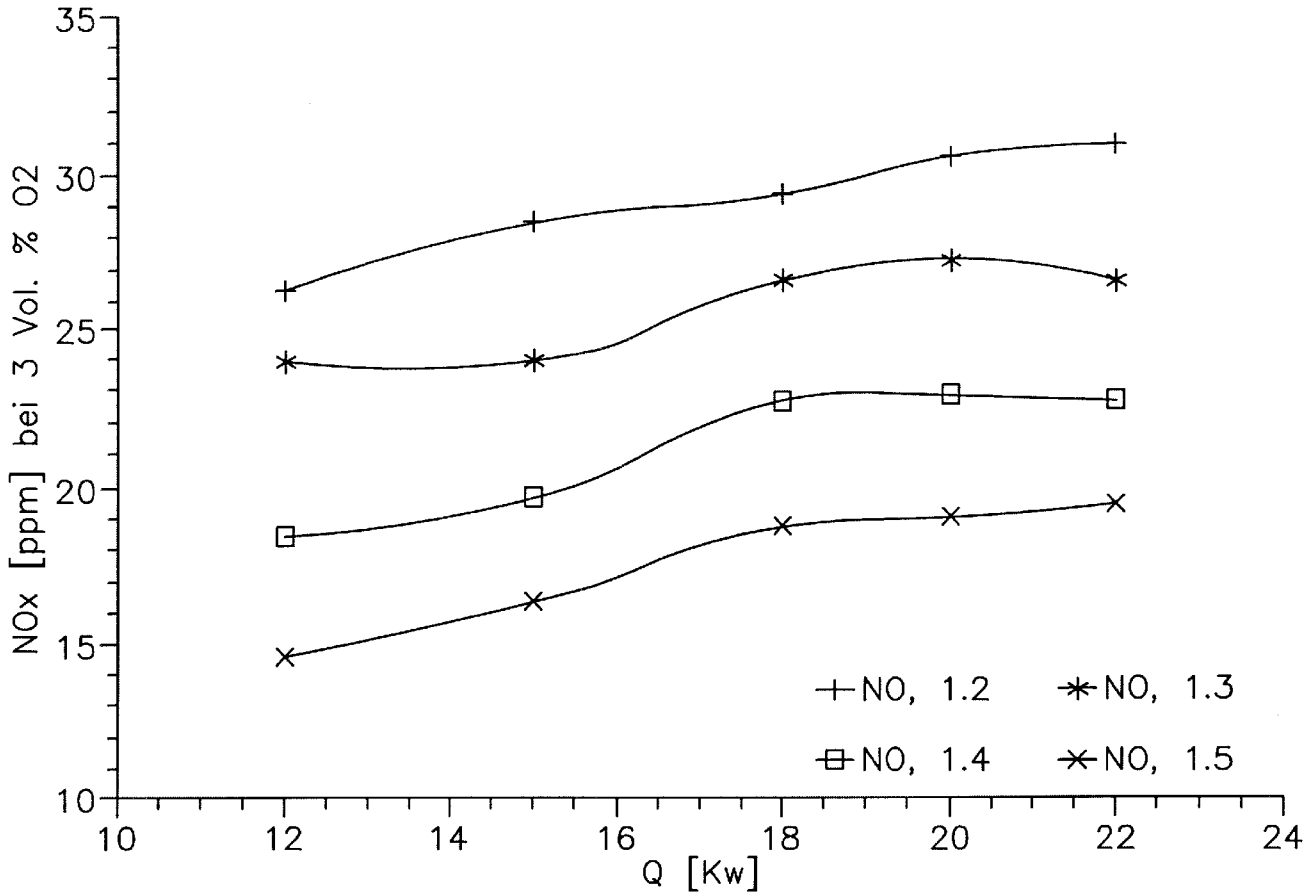
Figure 4B:
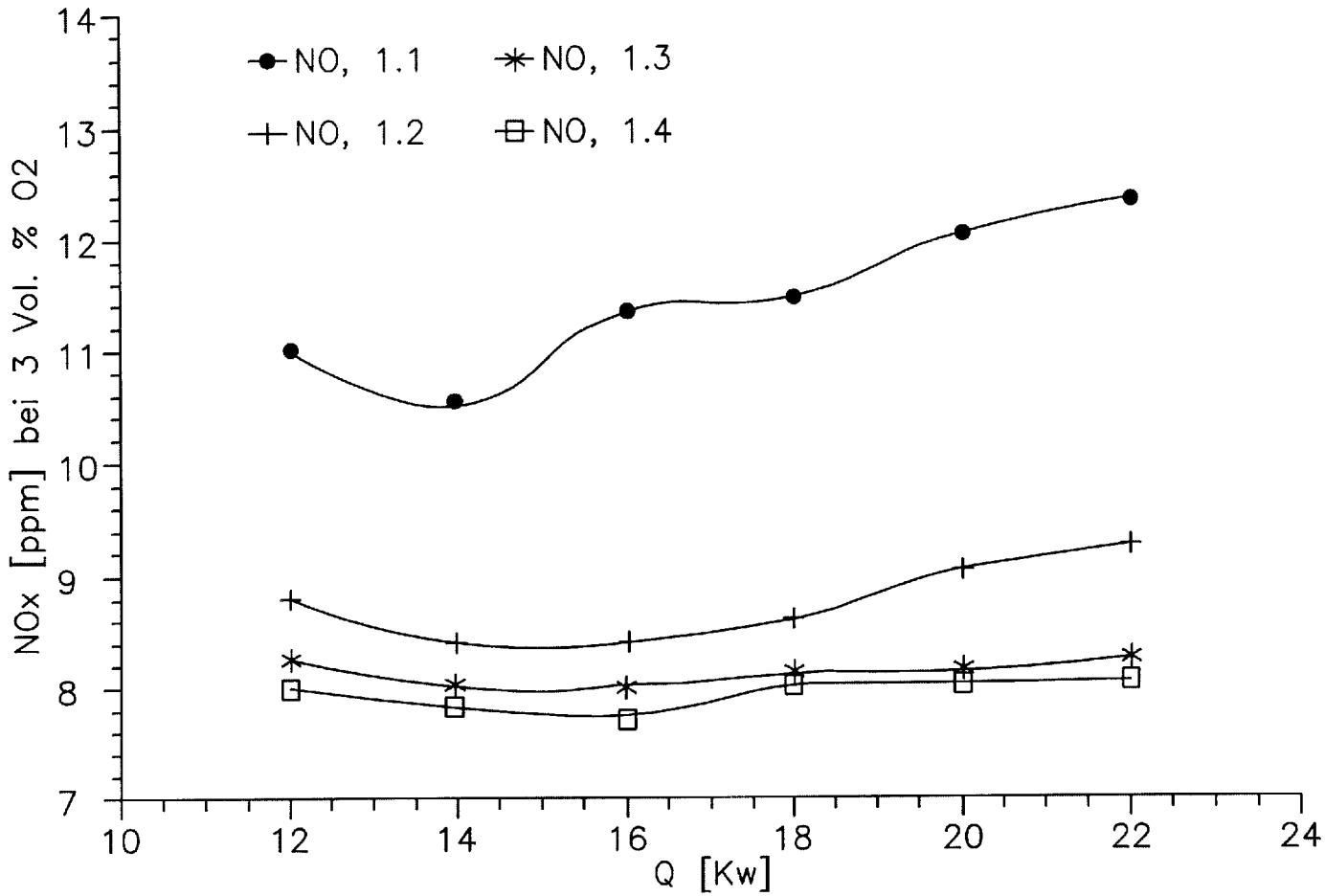
Figure 5A:
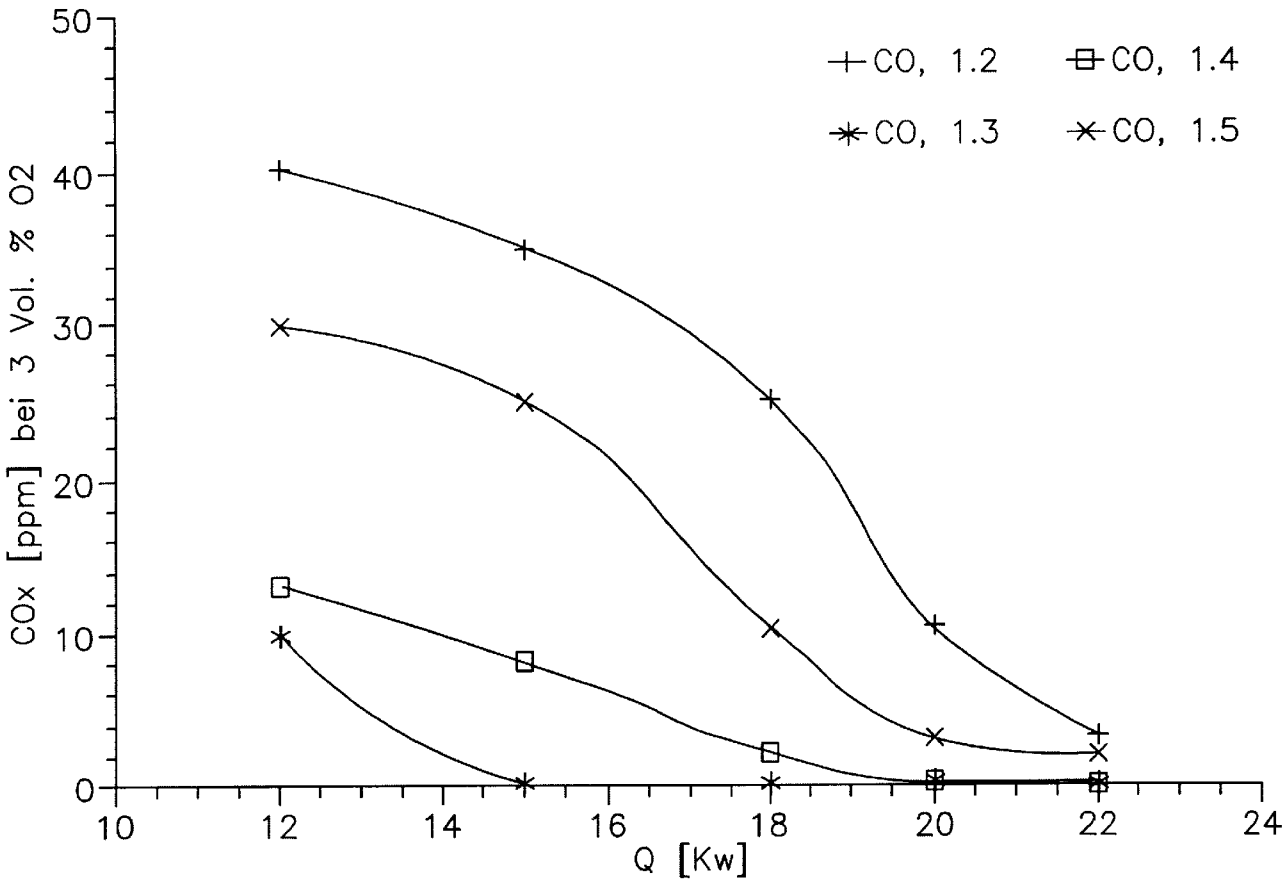
Figure 5B:
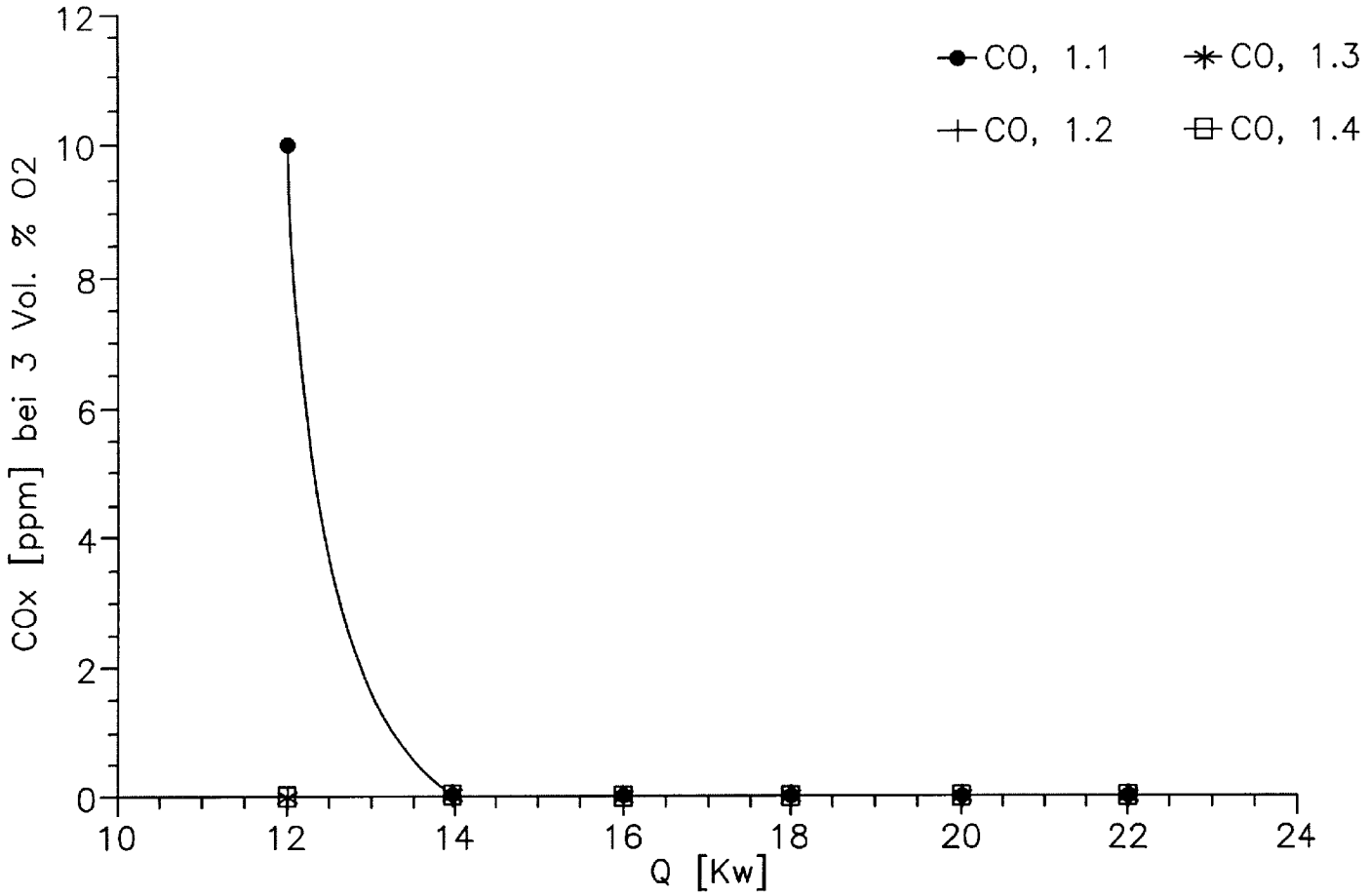

The novel features which are considered to be characteristic of the invention are set forth with particularity in the appended claims. The invention itself, however, in respect of its structure, construction and lay-out as well as manufacturing techniques, together with other objects and advantages thereof, will be best understood from the following description of preferred embodiments when read in connection with the appended drawings, in which:

FIG. 1*a* is a schematic presentation of a first embodiment of a low CO and low $NO_x$ combustion device with a conical combustion air distributor unit for heating purposes;

FIG. 1*b* is a schematic presentation of a second embodiment of a low CO and low $NO_x$ combustion device with a conical combustion air distributor unit for industrial purposes;

FIG. 2*a* is a schematic presentation of various geometric embodiments of combustion air distributor units in side and top elevation;

FIG. 2*b* schematically depicts the removability of a combustion air distributor unit;

FIG. 3*a* schematically depicts different possible jet flow directions from the fuel nozzles;

FIG. 3*b* schematically depicts the removability of the fuel nozzles;

FIG. 3*c* schematically depicts obliquely directed fuel bore holes;

FIG. 3*d* schematically depicts an annular fuel distribution slot with an internal swirl or helical flow generator;

FIG. 4*a* is a graph depicting the dependency of $NO_x$ emission values in the exhaust gas on the output of a burner in a first selected embodiment of a combustion air distributor unit operating without premixing of combustion air and fuel;

FIG. 4*b* is a graph depicting the dependency of the $NO_x$ emission values in the exhaust gas on the output of a burner in a second selected embodiment of a combustion air distributor unit operating with premixing of the combustion air and fuel (increased fuel-nozzle impulse);

FIG. 5*a* is a graph depicting the dependency of the CO emission values in the exhaust gas on the output of a burner in a third selected embodiment of a combustion air distributor unit operating without premixing of combustion air and fuel; and FIG. 5*b* is a graph depicting the dependency of the CO emission values in the exhaust gas on the output of a burner in a fourth selected embodiment of a combustion air distributor unit operating with premixing of combustion air and fuel (increased fuel-nozzle impulse).

DETAILED DESCRIPTION OF THE PREFERRED EMBODIMENTS

FIG. 1*a* depicts a cylindrical fire box or burner chamber 2 of a combustion device (not shown) with a longitudinal center axis 34. It is defined by a conical combustion air distributor unit 7 and an enclosing outer wall 3 made of steel. The outer wall 3 includes a cylindrical jacket wall 3*a*, a top wall 3*b*, and a bottom wall 3*c*. Fire box details, such as peep holes for visually observing the flame development in the fire box, openings for igniting the gas air mixture and for temperature measurements in the lower part of the fire box are not shown in the schematic drawing. An ultraviolet probe for monitoring the flame and a suction probe for removal of exhaust gases exiting at the exhaust gas exit 6, for analyzing the concentration of the exhaust gas are also not shown. The exhaust gas exit 6 is disposed in the top wall 3*b* of the fire box. The fire box or burner chamber 2 may alternatively be structured as a polygonal prism. However, the fire box or burner chamber 2 will always have a horizontally or vertically disposed longitudinal center axis 34.

Basically, it is a void space 1 between the outer wall 3 and the combustion air distributor unit 7 which is available for the formation of flames. This empty space 1 constitutes that part of the fire box 2 which is disposed below an imaginary level 10 defined by a free end or top portion 9 of the truncated cone-shaped combustion air distributor unit 7. The base 15 of the combustion air distributor unit 7 is disposed at the bottom wall 3*c* of the fire box 2.

For heating purposes the heat is conducted from the outer wall 3 by cooling water which flows either in pipe coils 16 (see right side of FIG. 1*a*) and/or in water chambers 17 between the outer and jacket walls 3, 3*a* (see left side of FIG. 1*a*).

The combustion air distributor unit 7 is made of common steel sheet and is provided with a plurality of openings 11 through which combustion air may at times enter into the combustion zone or void space 1. While the substantially horizontal top portion 9 of the combustion air distributor unit 7 is closed, its bottom portion 8 is open and is threadedly received in an air feed pipe 18. All of the combustion air or at least the largest portion of it (>70 vol-% of the total throughput of 100 vol-% required for the combustion) is conducted through the inner one 18 of a coaxial pipe leading into the interior of the combustion air distributor unit 7 from a blower 19 driven by a motor 20. The lower end of the pipe 18 of the coaxial pipe leads into a combustion air supply duct 5.

All of the fuel is fed separately or with the residual part of the combustion air (<30 vol-% of the entire combustion air throughput of 100 vol-%), as the case may be, to the combustion zone through a cylinder ring 21 disposed coaxially of the longitudinal center axis 34, between the inner pipe 18 and the outer wall 22 of the coaxial pipe. The lower end of the outer pipe 22 terminates in the fuel supply duct 4.

The specific reason for admixing the combustion air throughput with the fuel is to increase the fuel impulse.

The cylinder ring 21 is surrounding the bottom of the combustion air distributor unit 7 and is provided with an array of nozzles 12. This array of nozzles 12 consists of a plurality of fuel nozzles 13 disposed around the combustion air distributor unit 7. For the distribution of fuel in arbitrarily settable flow directions, the nozzles 13 can be adjusted in two planes disposed perpendicularly to each other and intersecting the longitudinal center axis 34 (see FIGS. 3*a*–3*d*).

Tests have been conducted with natural gas H serving as the fuel. In these tests, all structures of the combustion air distributor units 7 depicted in FIG. 2*a* in side and top elevation were utilized. The number of openings 11 for feeding combustion air to the combustion zone or their diameters were varied along the contour of the combustion air distributor units 7, so that by adjusting the ratios of the mixtures the combustion process could be controlled.

For relatively small combustion air distributor units (length 25–30 cm, bottom width 2–3 cm, top width 0–10 cm in a burner chamber of 80 cm length), the output was set to values between 10 and 22 kW and the air λ-number was varied between 1.1 and 1.5. This does not, however, represent any kind of limitation. The distributor unit shown in FIG. 1*a* to which the measurement values of FIGS. 4 and 5 refer, was of a width of about 2.5 cm at the bottom at an overall length of about 30 cm. In every test series, a thin slightly luminous (given operational variants, nearly invisible and invisible flames were also possible) stable and turbulent flame developed around the combustion air distributor unit 7, and total combustion could be recorded slightly above the imaginary level 10 above the combustion air distributor unit 7. While the flame did not touch the surface of the combustion air distributor unit 7, it did fill large portions of the void space 1. The result was an intensive heat transfer to the outer wall 3 of the fire box. This necessarily resulted in an improved and more intense heat exchange with the heat transfer medium in the pipe coils 16 or the water chambers 17 disposed in or around the fire box wall 3*a*, 3*b*, 3*c*.

The contour of the combustion air distributor unit 7 did not glow and it remained relatively cool, below 30020 C., in all structural embodiments of FIG. 2*a*. The exhaust gas analysis showed, as reflected in the data of FIGS. 4*a*, 4*b*, 5*a* and 5*b*, particularly at an increased fuel nozzle impulse, extremely low $NO_x$ and CO emission values which are not only significantly below legal limits for industrial combustion devices, but also below limits proposed in new legislation relating to boiler furnaces.

A substantial advantage of the invention resides in the possibility of constructing an energy-saving and environmentally friendly combustion plant of a compact burner and combustion chamber structure suitable for generating heat at lower output levels up to 100 kW (such as, for example, household appliances, wall heaters, and hot water heaters) as well as at medium output levels above 100 kW up to 1 MW (such as, for example, heating centers, heat generating plants, power stations and biological waste incinerators) and at high output levels above 1 MW (such as, for example, power station furnaces and rotary furnaces). The combustion chamber of such plants is substantially reduced in size compared to conventional combustion chambers, because of their superior heat transfer ratio. In summary, for ecological and economic reasons the novel combustion device offers more advantages than do conventional combustion techniques.

FIG. 1*b* schematically depicts an arrangement of a plurality of combustion devices for industrial purposes relating to power station technology. The fire box 2 is of square cross-section; the illustrated combustion devices have characteristics similar to those shown in FIG. 1*a* and are installed at the lower wall 3*c* as described supra. Heat transfer takes place by way of the water pipes 23 built into the outer wall as well as by way of an evaporator 24 and a superheater 25. Further heat transfer is achieved through an air preheater which preheats the combustion air to the temperature of the exhaust gas emitted through the channel or opening 6 as schematically indicated.

FIG. 2*a* is a schematic illustration of various geometrical variants of the combustion air distributor units. They may be of rectangular parallelepiped, cylindrical, conical, polygonally prismatic or pyramidal configuration, or their contours may be of ellipsoidal or hyperbolical shape. Other geometric structures are possible as well. In principle, all combustion air distributor units exhibit a hollow interior for feeding combustion air, a thin, perforated or porous wall surrounding the hollow structure, a closed top portion, and an open bottom. The dimensions of the combustion air distributor units and the number and geometry of the openings in their circumferential surface must be selected such that they insure a controlled combustion process around the combustion air distributor unit. Hence, by selecting these parameters, air supply to the combustion zone is to be controlled as a function of burner output in accordance with specific requirements of a combustion process, such that sub-stoichiometric combustion occurs over a substantial range of the burner and that total conflagration will not have taken place until close to the top portion of the combustion air distributor unit. Measurements have shown that different dimensions of the combustion air distributor units are required for different burner outputs. For this reason, combustion air distributor units for specific load ranges should be custom-made and should be exchangeable. As schematically shown in FIG. 2*b*, this can be accomplished in the following manner: The bottom portion 8 of the combustion air distributor unit 7 is provided with an external thread 26 and the air feed pipe 18 at its mouth is provided with an internal thread. The combustion air distributor unit 7 is screwed into the air feed pipe 18. Measurements have confirmed that to achieve a stable low pollution and complete combustion, the following values should be set as regards the combustion air distributor unit (see FIG. 1*a*):

The length A of the combustion air distributor unit 7 should be equal to or greater than 40–85% of the length B of the burner chamber, the diameter C of the combustion air distributor unit 7 at its bottom portion 8 should be equal to or greater than 10% of the diameter D of the burner chamber, and the porosity of the combustion air distributor body should be less than 20%.

FIG. 3*a* is a schematic rendition of variants of the jet flow direction of the fuel nozzles 13 disposed in an annular array 12 or several nozzle arrays (not shown) at the bottom portion 8 of the combustion air distributor unit 7. The nozzles 13 are surrounding the base of the combustion air distributor unit 7 in an annular disposition. A nozzle array 12 includes a plurality of nozzles 13 whose jet flow direction 14 may be adjusted relative to the longitudinal center axis 34 as well as diagonally. On the one hand, this allows distribution of fuel to different zones of the combustion air distributor unit 7 which contributes to a guided control of the mixture ratios and improves ignition. On the other hand, by suitably inclining the nozzles or fuel jets, the fuel can be subjected to swirl to enhance the mixing of fuel and combustion air and to extend the time during which the fuel particles dwell in the flame region. The two fuel nozzle settings in axial and tangential inclination in connection with the air continuously flowing from the openings of the combustion air distributor unit 7 ensure low $NO_x$ and CO emission. It has been found that the optimum range of the axial and tangential sloping angles of the fuel nozzles lies between about −45° and about +45° relative to the longitudinal direction of the combustion zone. The angle setting depends on the shape or the combustion air distributor unit and has a marked influence on the quality of the combustion. The admixture of a small amount of air (<30% of the total combustion air flow) to the fuel leads to an improved mixing of fuel and combustion air and to the ignition point (limit) being reached earlier because of the increased fuel impulse. This leads to a drastic reduction of $NO_x$ values.

The nozzle arrangement should be made to accommodate different load regions and should be exchangeable. This can be accomplished in the following manner (see FIG. 3*b*): Directly before the fuel enters into the fire box, the coaxial ring 21 is closed and is provided with connection channels 32 for feeding fuel into the fire box. The channels 32 are provided with internal threads 33, and the fuel nozzles 13 are provided with matching external threads 28. The fuel nozzles 13 are screwed into the connection channels 32. Inclined bore holes 29 or an annular slot 30 with an internal turbulence generator 31 may be used instead of the fuel nozzles 13 as shown in FIGS. 3*c* and 3*d*.

The many different possibilities of configuring the nozzles allows their application in connection with liquid, gaseous or pulverized fuels.

The graphs of FIGS. 4*a* and 5*a* show $NO_x$ and CO emission values measured in combustion device or burner outputs at different air λ-numbers for the embodiment illustrated in FIG. 1*a* provided with a conical combustion air distributor unit 7. Natural gas H was used as the fuel and fed through a single nozzle array. The nozzles were set such that every other nozzle provided a slight rotational vortex or swirl (turbulence). While the output of the combustion device or burner of the relatively small test plant was varied between 10 and 22 kW, the air λ-numbers were set for ranges between 1.2 and 1.5 which are conventional in, and of interest in connection with, furnaces. The stated $NO_x$ and CO emission values were converted or recalculated for 3 vol-% $O_2$ in the exhaust gas to allow comparison with the limit values set forth in a 1964 German governmental regulation.

It can be clearly seen in FIG. 4*a* that the $NO_x$ emission values in this embodiment of the combustion air distributor unit 7 increase slightly with the burner load as a result of increasing combustion temperatures. Since in all tests the flame temperature remained below 1,200° C., the $NO_x$ emission values tend to level off at higher outputs. An increase in the air λ-number leads to a drastic reduction of $NO_x$ emission values. For example, the maximum $NO_x$ emission value drops from 31 ppm to 19.5 ppm in case of air λ-number 1.2 and an output of 22 kW, compared to air λ-number 1.5 at the same load.

The increase in impulse due to the fuel nozzles is significant for further reducing the $NO_x$ emission values. Thus, a slight addition of air to the fuel causes strong swirl (turbulence) and improved mixing of fuel and combustion air. The ignition point (limit) is reached sooner. Furthermore, the flame becomes thinner and expanded over a larger area, and in the present example, it will burn hardly visible at all, at about 20% combustion air admixed to the fuel. FIG. 4*b* shows extremely low $NO_x$ emission values for all air λ-numbers and in all tested load ranges at an admixture of 20% combustion air to fuel and at settings otherwise identical to those of FIG. 4*a*.

Looking at corresponding CO emission values in FIG. 5*a*, it will be seen that the CO emission values are generally very low and tend to disappear completely (0 value) in case of increasing burner output and air λ-number. The impulse increase of the fuel nozzles as a result of mixing about 20% combustion air to the fuel leads, as shown in FIG. 5*b*, to a total combustion. The exhaust gases are free of CO in case of air λ-number greater than 1.05 and at all tested outputs. This behavior as regards CO emission is also typical of all other structures and shapes of combustion air distributor units. The experimental tests show that the zero values of CO emission may be quickly achieved by appropriately setting the fuel nozzles.

The axial and tangential setting of the fuel nozzles has a particular effect on the formation of $NO_x$ and CO, different optimum angular positions resulting depending on the utilized combustion air distributor unit.

In summary, it can be said that the $NO_x$ and CO emission values of the novel combustion device are significantly below the limit values of the German clean air regulations (NO: 114 ppm, CO: 93 ppm) and of the new German regulation BimSchV (NO: 45 ppm, CO: 55 ppm), and that it is even possible to generate CO-free exhaust gas from combustion processes.

Individual elements of the different embodiments shown in the drawings may be combined with each other as desired without departing from the essence and spirit of the present invention or from the scope of protection defined by the appended claims.

SUMMARY

1. Combustion device and Method for Operating a Combustion Device for a Low $NO^x$ and Low CO Combustion.
2. There exists a tendency in the construction of combustion devices to employ a multi-level, spatially distributed feed of the combustion air in order to be able to better influence the stoichiometric ratios during the combustion. These solutions are little suited for the compact construction and, in addition, the flame temperature is too high in the region of the air feed relative to a low $NO^x$ combustion if one does not employ expensive constructions with additional cooling bodies.

2.2. These problems are avoided if the combustion air is fed into the combustion zone by means of one or several combustion-air distributor bodies (7) in the inner space of a largely hollow-cylindric-like space section, filled by the flame, along the entire or a large part of the length of the flame. For this purpose, a plurality of openings for the air exit are distributed over the contour of the combustion-air distributor body. In contrast, the fuel is introduced only in the region of the bottom part of the combustion-air distributor bodies, i.e. in the region of the base of the flame, by means of at least one nozzle row (12) including several fuel nozzles, wherein the nozzle row is disposed around the combustion-air distributor bodies. It has proven to be particularly effective for an optimum preservation of the predetermined value regions of the air number lambda if the jet-flow direction of the fuel nozzles within the same nozzle row and/or the jet-flow direction of the fuel nozzles of neighboring nozzle rows are directed to different longitudinal regions of the combustion-air distributor bodies. The admixture of small amounts of air to the fuel leads to a strong dilution of the flame and to a drastic decrease of the $NO^x$ and CO emission.

What is claimed is:

1. An apparatus for burning combustible fuel at a low emission of $NO_x$ and CO, comprising:

an elongate housing forming a combustion chamber having a side wall mounted substantially concentrically of a predetermined axis, a first wall normal to the axis and forming a first opening therein disposed concentrically of the axis for the emission of hot exhaust gas and a second wall disposed substantially parallel to the first wall and forming a second opening therein concentrically of the axis;

an elongate hollow member comprising a third wall perforated throughout its surface mounted concentrically of the axis within the combustion chamber at a predetermined spacing from the side wall and defining a closed end at a predetermined distance from the first wall and an open end disposed in the second opening;

a first pipe connected to the open end for feeding air through the perforations in a continuous graduation; and a second pipe disposed around the first pipe and defining therewith within the second wall an annular orifice for feeding the fuel in a predetermined direction into the combustion chamber between the side wall and the third wall for mingling and burning with the air from the perforations.

2. The apparatus of claim 1, wherein the orifice comprises an annular gap concentrically surrounding the first pipe and provided with means for imparting turbulence to the fuel.

3. The apparatus of claim 2, wherein the means for imparting turbulence comprises a plurality of nozzles placed to direct jets of fuel into the combustion chamber in a predetermined flow pattern.

4. The apparatus of claim 1, wherein the first pipe terminates in the second wall and the elongate member is threadedly connected to the first pipe.

5. The apparatus of claim 1, wherein the third wall is made of one of sheet metal and ceramics.

6. The apparatus of claim 1, wherein the ratios of the side wall, first and second walls relative to the longitudinal and lateral dimensions of the elongate member are such that the fuel and air form a combustible mixture for a uniform conflagration.

7. The apparatus of claim 3, wherein the plurality of nozzles is disposed substantially concentrically around the elongate member.

8. The apparatus of claim 3, wherein the nozzles are independently movable for adjusting the direction of the jets.

9. The apparatus of claim 8, wherein the perforations in the third wall are disposed at a first level from the second wall and wherein the nozzles protrude into the combustion chamber to a second level not exceeding the first level.

10. The apparatus of claim 1, wherein the perforations are configured to impart swirl to the air entering the combustion chamber.

11. The apparatus of claim 1, further comprising means for adjusting the stoichiometric ratio of air relative to air.

12. The apparatus of claim 1, wherein the perforations are disposed for adjusting air numbers (λ-numbers) from a sub-stoichiometric range in the vicinity of the second wall to a super-stoichiometric range in the vicinity of the closed end.

13. The apparatus of claim 1, wherein the perforations are disposed for deflecting the conflagration flame away from the third wall by the air flowing therethrough.

14. The apparatus of claim 1, wherein the elongate member is of one of polygonal and circular cross-section.

15. The apparatus of claim 14, wherein the elongate member is of one of rectangular, trapezoidal, ellipsoidal and hyperbolic axial section.

16. The apparatus of claim 8, wherein the nozzles are removably mounted.

17. The apparatus of claim 1, further comprising means for heating the air by the hot exhaust gas prior to entering the elongate member.

18. The apparatus of claim 1, further comprising conduits in the side wall for receiving a heat transfer medium.

19. A method of burning a combustible fuel at a low emission level of $NO_x$ and CO, comprising the steps of:

feeding from about 70% to substantially 100% of the air required for the combustion in substantially radial directions and in continuous graduation through perforations in an elongate member into a combustion zone of an enclosing combustion chamber;

mixing any remaining air required for the combustion with the fuel; and feeding jets of fuel and the remaining air from one end of the elongate member so as to intersect the radial direction of fed air at angles of inclination depending on fuel and operational parameters providing a substantially invisible flame.

20. The method of claim 19, wherein the angles of inclination are between +45° and −45° relative to the longitudinal direction of the combustion zone.

* * * * *